US006029774A

United States Patent [19]

Cothern

[11] Patent Number: 6,029,774

[45] Date of Patent: Feb. 29, 2000

[54] LADDER STABILIZING ASSEMBLY

[76] Inventor: Larry G. Cothern, 1780 Petersburg Rd., Boston, Ky. 40107

[21] Appl. No.: 09/206,410

[22] Filed: Dec. 7, 1998

[51] Int. Cl.[7] ..... E06C 7/48

[52] U.S. Cl. ..... 182/107; 182/214

[58] Field of Search ..... 182/107, 214, 182/206

[56] References Cited

U.S. PATENT DOCUMENTS

| | | | |
|---|---|---|---|
| 2,797,037 | 6/1957 | Niedojadlo | 182/107 |
| 3,419,109 | 12/1968 | Costlow | 182/214 |
| 3,708,080 | 1/1973 | Schlei | 182/214 |
| 3,712,419 | 1/1973 | O'Hara | 182/107 |
| 4,164,269 | 8/1979 | Jackson | 182/229 |
| 4,502,566 | 3/1985 | Wing | 182/107 |
| 4,643,275 | 2/1987 | LeBlanc | 182/107 |
| 4,765,439 | 8/1988 | Kresmery | 182/107 |
| 5,622,238 | 4/1997 | Farmer | 182/214 |
| 5,628,381 | 5/1997 | Markovich et al. | 182/107 |
| 5,664,643 | 9/1997 | Taylor, Jr. | 182/214 |
| 5,743,356 | 4/1998 | Mitchell | 182/214 |
| 5,775,465 | 7/1998 | Vossler | 182/214 |

*Primary Examiner*—Alvin Chin-Shue
*Attorney, Agent, or Firm*—Maurice L. Miller, Jr.

[57] ABSTRACT

A safety assembly for stabilizing the legs of a ladder is disclosed which includes an elongated support bar, a pair of U-shaped, spaced apart, ladder leg coupling elements mounted on opposite end portions of the support bar and means, such as a pair of brackets, for attaching the support bar to a building or structure against which a ladder is to be operatively positioned. The coupling elements confine the legs of the ladder therein to prevent the ladder from tilting sideways as a person climbs off of or onto the ladder onto or off of the structure. An additional safety feature includes a pair of ladder leg snugging pins which are removably inserted laterally through the legs of the coupling elements to tightly or snuggly confine the ladder legs in the coupling elements. Still another safety feature includes a pair of pivotally movable latches which have a closed position across the otherwise open ends of the coupling elements, which latches can be swung inwardly by means of a pull cord to an open position so that the ladder legs can be removed from the coupling elements by a person standing on the ground in front of the ladder. A pair of springs bias the gates to a normally closed position against a stop member.

18 Claims, 8 Drawing Sheets

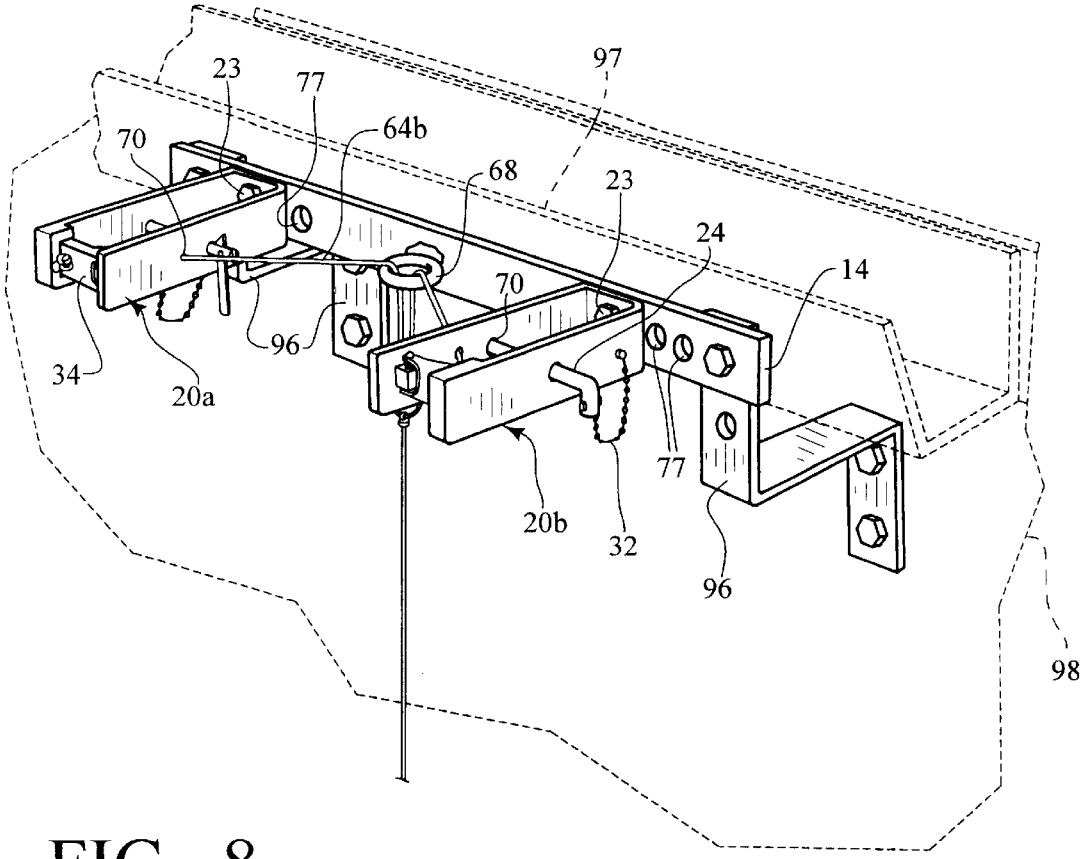
FIG. 8
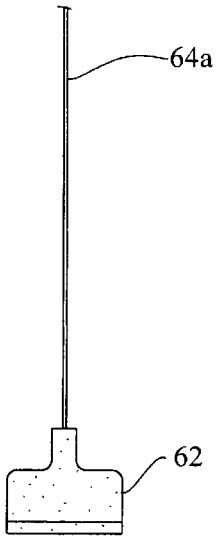

LADDER STABILIZING ASSEMBLY

BACKGROUND OF THE INVENTION

This invention relates generally to a safety device for attachment to a building structure, storage tank, utility pole or the like for stabilizing an upper end portion of a ladder. More specifically, the invention relates to a ladder stabilizing assembly which includes an elongated support member, a pair of U-shaped, spaced apart, ladder leg or rung coupling elements connected to opposite end portions of the support member, and various different types of mounting brackets for securing the support member to a building structure, storage tank, utility pole, etc. Additional features include a safety latch mounted across the otherwise open end of each of the coupling elements and snugging pins which are manually insertable through and removable from the coupling elements to trap the ladder legs or a ladder rung within the coupling elements until it is desired to remove the same from the assembly. A pull cord, operable by pulling down on a pull cord handle located at a convenient height above the ground near where the base of the ladder rests when operatively confined in the assembly, can be actuated to open the latches so that the ladder legs can be removed from the coupling elements when desired.

Broadly speaking, ladder leg and ladder rung stabilizing devices for securing an upper end portion of a ladder to a structure against which the ladder is leaned are well known in the prior art. See U.S. Pat. No. 5,775,465 granted to D. J. Vossler on Jul. 7, 1998; U.S. Pat No. 5,743,356 granted to F. A. Mitchell on Apr. 28, 1998; U.S. Pat. No. 5,628,381 granted to D. H. Markovich et al. On May 13, 1997; U.S. Pat. No. 4,765,439 granted to R. C. Kresmery on Aug. 23, 1988; U.S. Pat. No. 3,712,419 granted to C. F. O'Hara on Jan. 23, 1973; and U.S. Pat. No. 4,164,269 granted to C. E. Jackson on Aug. 14, 1979, all of which disclose ladder leg stabilizing devices. See also U.S. Pat. No. 5,664,643 granted to R. F. Taylor, Jr. on Sep. 9, 1997 and U.S. Pat. No. 4,643,275 granted to G. J. LeBlanc on Feb. 17, 1987, both of which disclose ladder rung attachment devices. Finally, see U.S. Pat. No. 5,622,238 granted to R. M. Farmer on Apr. 22, 1997 which discloses a ladder stabilizing device which is attachable to both the legs and a rung of a ladder.

First, none of these prior art devices can be used to secure the legs of a ladder when mounted along an outer rafter of a sloping roof structure so as to extend diagonally relative to the ground beneath the ladder. Second, none of these prior art devices can be used to secure either both legs of a ladder or, in the alternative, a rung of the ladder as desired. Third, none of these prior art devices utilize spring operated safety latches which are biased to a closed position to trap the legs or a rung of a ladder within a pair of coupling elements. Fourth, none of these prior art devices have safety latches which can be readily opened by a ladder user while standing near the base of the ladder when it is desired to remove the ladder from the safety device. Fifth, none of these prior art devices have the capability of being attached to a wide variety of different structures simply by changing the type of mounting brackets used with the device. Sixth, none of these prior art devices use snugging pins which are readily inserted to snug the legs of a ladder in the device and which are readily removable when it is desired to remove the ladder from the device.

By means of my invention, these and other problems and shortcomings encountered when using prior art ladder stabilizing devices are substantially overcome.

SUMMARY OF THE INVENTION

It is an object of my invention to provide a safety assembly for stabilizing a ladder to prevent the ladder from tilting sideways during use.

It is a further object of my invention to provide such an assembly which can be mounted in a more or less permanent manner to the side of a building, pole, tank or other structure.

It is another object of my invention to provide such an assembly including spaced apart coupling elements to removably confine the legs of a ladder therein and to provide additional safety features such as ladder leg snugging pins and pivotally movable safety latches, which latches have a normally closed position to confine the legs in the elements and an open position to permit removal of the ladder from the assembly as desired.

Briefly, in accordance with my invention, there is provided a ladder safety assembly for stabilizing an upper end portion of a ladder when the ladder is disposed in an operative position against a structure to which the assembly is fastened. The assembly includes an elongated support member and means for attaching the support member to a structure against which a ladder is to be placed. Also included are first and second ladder leg coupling elements attached to opposite end portions of the support member. Each of the elements has an open end projecting forwardly from the support member for insertion of a different leg of the ladder therethrough into a corresponding one of the elements.

These and other objects, features and advantages of the present invention will become apparent to those skilled in the art from the following detailed description and attached drawings, upon which, by way of example, only a preferred and other important embodiments of my invention are described and illustrated.

BRIEF DESCRIPTION OF THE DRAWINGS

FIG. 8 shows a perspective view of the assembly substantially as shown in FIGS. 1–7 with the mounting brackets for mounting the assembly in front of a roof gutter, the brackets being attachable to a vertical building wall below and behind the gutter.

DESCRIPTION OF THE PREFERRED EMBODIMENT

Figure 1:
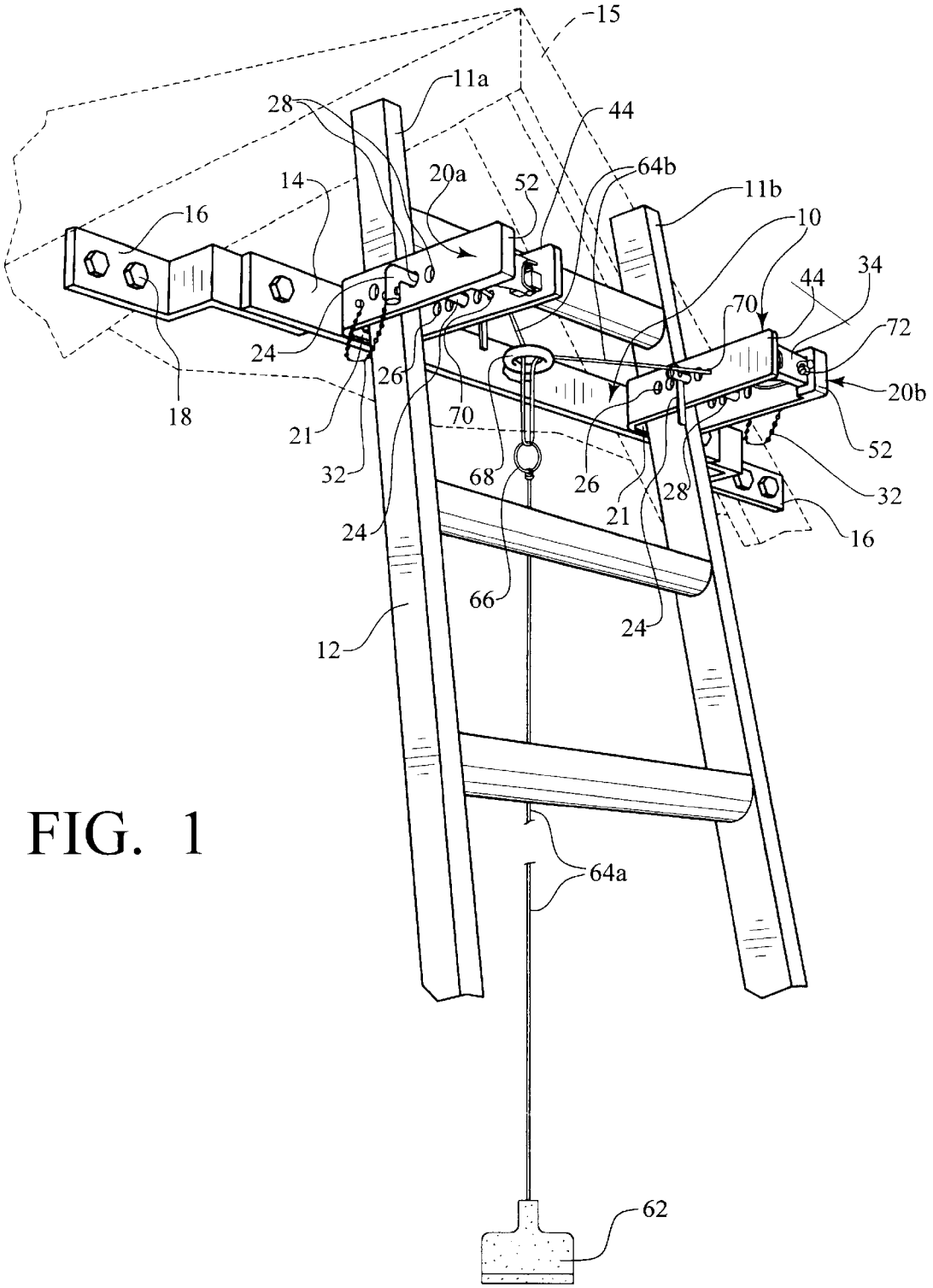
FIG. 1 shows a perspective view of a ladder stabilizer assembly with mounting brackets adapted for attachment of the assembly horizontally across an upper end portion of a gable of a building, and a ladder operatively positioned in the assembly, thus illustrating a preferred embodiment of my invention.
Figure 2:
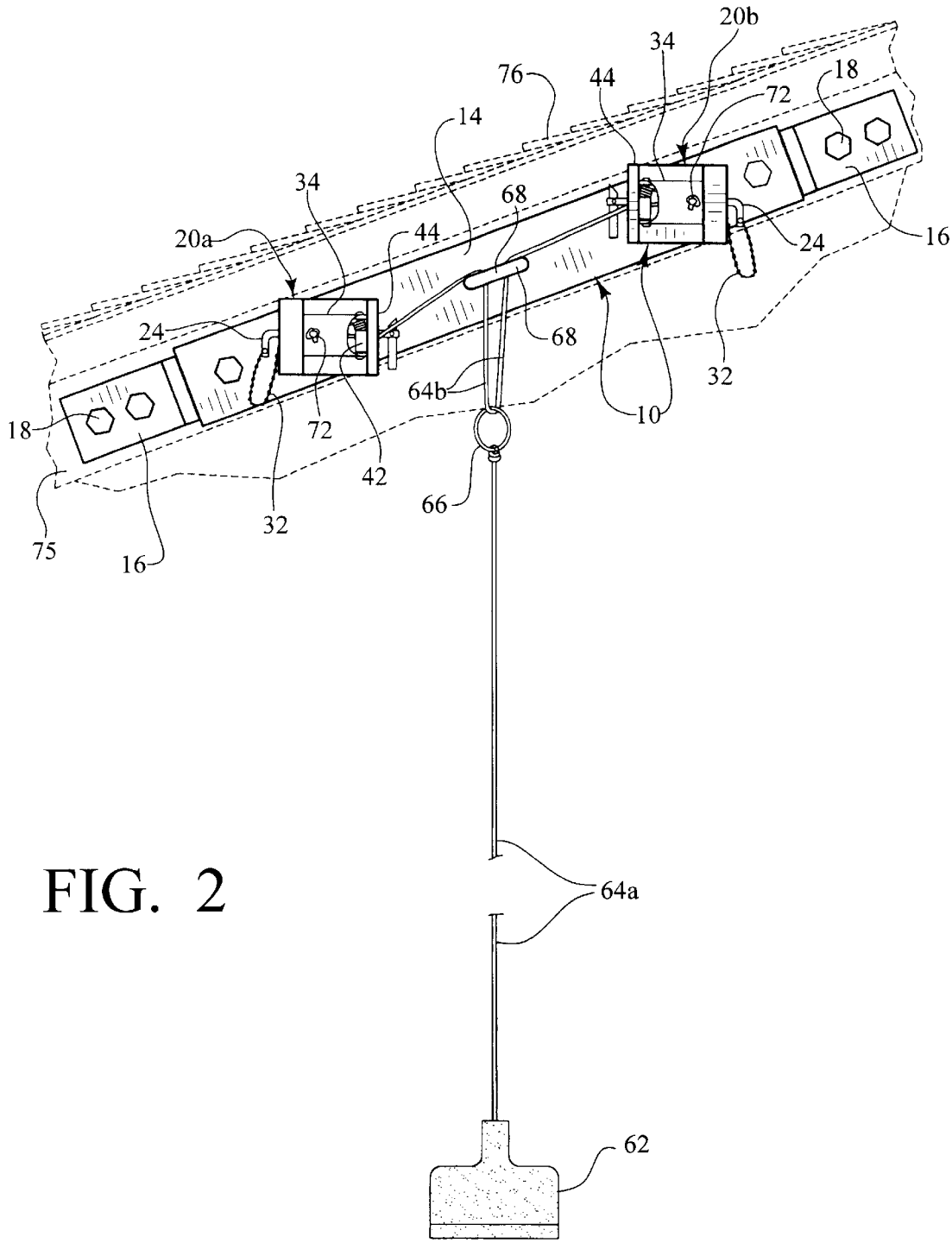
FIG. 2 shows a front elevation view of the assembly and brackets of FIG. 1 except that, in this view, the brackets are aligned with the assembly to permit mounting of the assembly along an outer rafter of a slanted roof so as to extend diagonally and parallel with the roof.
Figure 9:
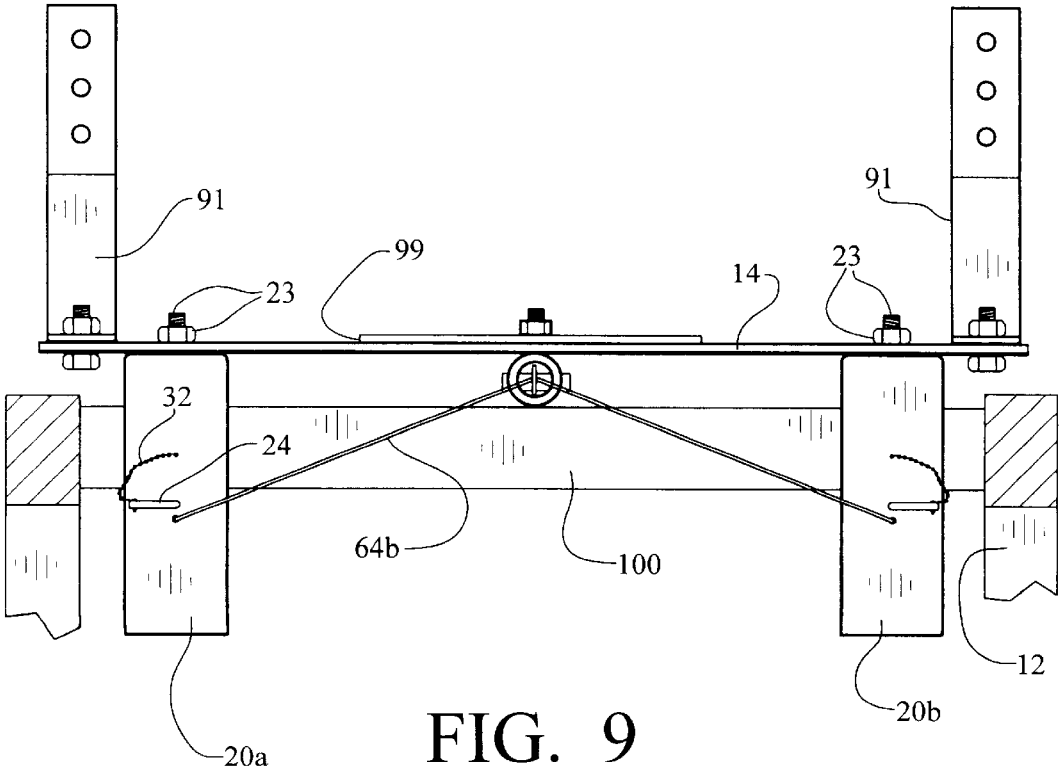
FIG. 9 shows a top plan view of the assembly substantially as shown in FIGS. 1–8 with mounting brackets the same as in FIGS. 5–6, the assembly being arranged for grasping a rung of a ladder as also shown.

Referring now to the drawing figures and, in particular, to FIGS. 1–2, there is shown, in a preferred embodiment of my invention, a ladder safety assembly, generally designated 10, for stabilizing upper end portions of a pair of legs 11*a* and 11*b* of a ladder 12, the ladder being shown only in FIG. 1. The assembly 10 is preferably made of steel. Broadly speaking, the assembly 10 includes an elongated, relatively flat support bar or member 14, a pair of offset mounting brackets 16 for securing the support member by means of bolts 18 to a structure against which the ladder 12 is to be leaned as, for example, a gable 15 (FIG. 1 only) of a house, and a pair of spaced apart, U-shaped, ladder leg coupling elements, generally designated 20*a* and 20*b*. While the support member 14 and coupling elements 20*a* and 20*b* are identical throughout the drawing figures, whereby similar numbers are used to designate similar structural elements, various different means for mounting or securing the support member to a structure, o other than the brackets 16 of FIGS. 1–2, are shown in the remaining figures. The coupling elements 20*a* and 20*b* are removably attached on their bases 21 by means of suitable fasteners 23 to opposite end portions of the support member 14, as shown best in FIG. 6, so that the ladder legs 11*a* and 11*b* will insert through the forwardly projecting open ends thereof to be confined therein. Such fastening means also permits the coupling elements 20*a* and 20*b* to be rotationally displaced relative to the support member 14 to permit coupling to a ladder rung 100 as shown in FIG. 9 or tilting of the support member 14 to extend along a sloping roof rafter 78 as shown in FIG. 2. A medial leg 44 and an opposing lateral leg 52 of each of the elements 20*a* and 20*b* thus prevent the ladder 12 from being tilted sideways, often with disastrous results, as a person attempts to climb off the ladder onto the structure against which the ladder is leaned or from the structure onto the ladder. Several pairs of holes 77 (See FIG. 8) in the support member 14 permit adjustment of the center-to-center spacing between the elements 20*a* and 20*b* to accommodate ladders of different widths or to permit tilting of the support member 14 so that it can extend diagonally along a sloping roof rafter (See FIG. 2).

Figure 6:
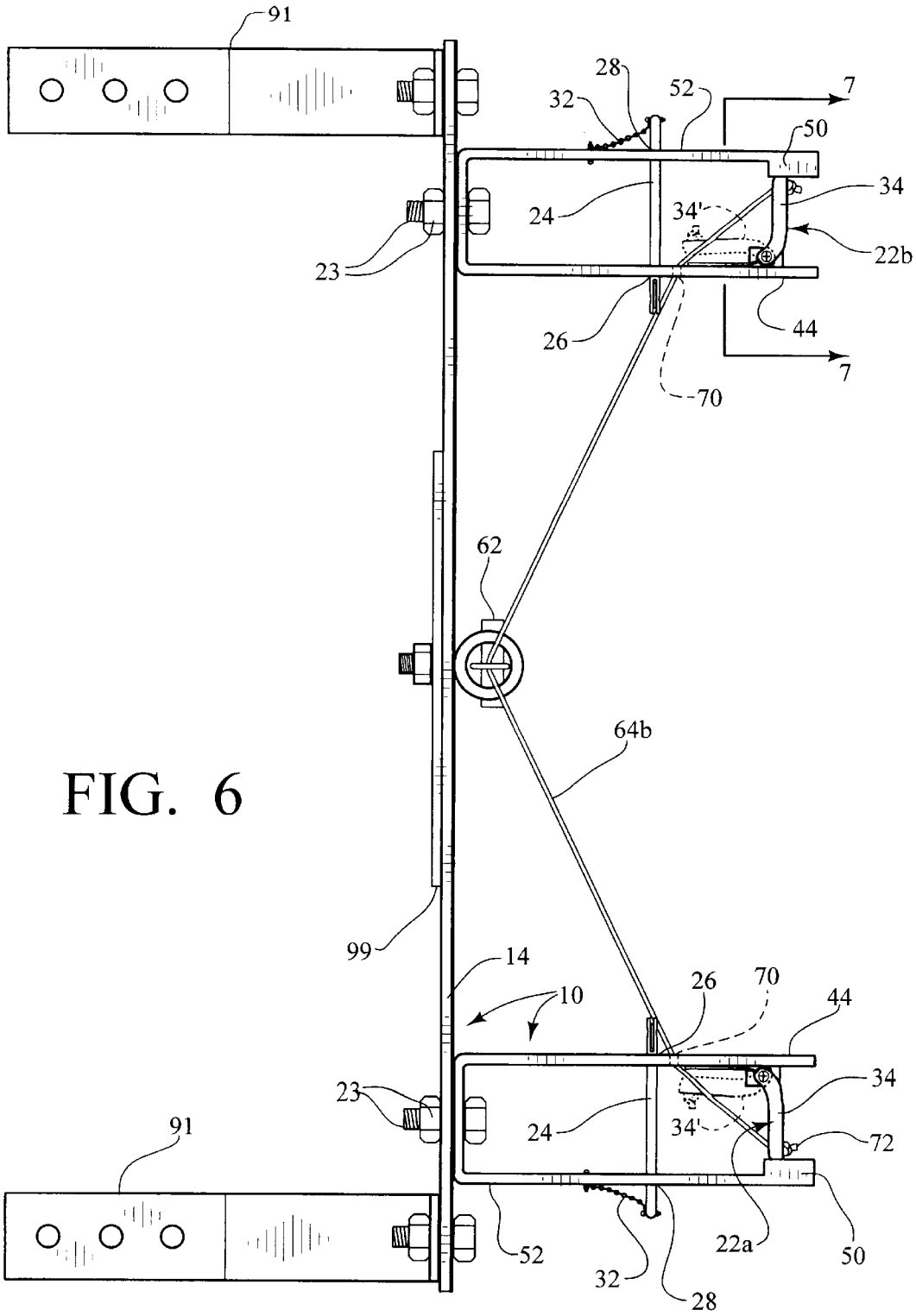
FIG. 6 shows a top plan view of essentially the same assembly as shown in FIGS. 1–5 with cornice mounting brackets the same as shown in FIG. 5.
Figure 7:
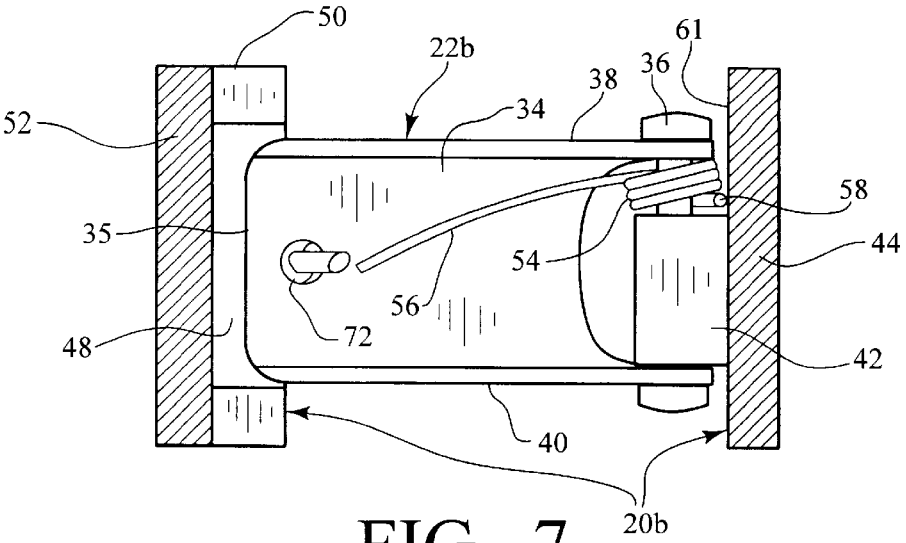
FIG. 7 shows a cross-sectional view of a fragment of the assembly of FIGS. 1–6 as viewed along cross-section lines 7—7 of FIG. 6.

As shown best in FIGS. 6–7, th e coupling elements 20*a* and 20*b* are also provided with additional safety features such as latches, generally designated 22*a* and 22*b*, and ladder leg snugging pins 24, preferably of the well known gravity pin type as shown. Such gravity pins have a pivotal end portion which turns 90 degrees under the influence of gravity to prevent the pins from being accidentally withdrawn from the coupling elements until the pivotal ends are first straightened to align them with the remainder of the pin bodies. The pins 24 are each removably insertable through one of several aligned pairs of holes, 26 and 28, (See FIG. 1) formed in the coupling element legs 44 and 52, respectively, and should be attached by cords or chains 32 to the legs 52 so as to be readily available at the site of their use when needed. The several pairs of registered holes 26 and 28 permit close confining of ladder legs of different sizes within the coupling elements 20*a* and 20*b*. The latches 22*a* and 22*b*, as exemplified by the latch 22*b* shown in detail in FIG. 7, include a gate 34, pivotally attached on one side thereof by a pivot pin 36 which is inserted through registered holes formed in an upper and a lower surface 38 and 40 of the gate, respectively, and through a block 42 attached to an interior facing wall 61 of the medial coupling element leg 44. A free end of the gate 34 rests flush against a base 48 of a slot formed in a stop member 50 attached to an interior facing surface of the lateral leg 52 when the gate is in its closed position as shown in FIG. 7. The gate 34 can be swung inwardly of the coupling 22*b* to its open position, as shown in phantom in FIG. 6 at 34'. A biasing means in the form of a coiled spring 54 surrounding the pivot pin 36 and confined between the upper gate surface 38 and an upper end of the block 42 and having end portions 56 and 58 (See particularly FIGS. 6–7) which extend in a relatively straight line along and against the gate 34 and interior facing wall 61 of the leg 44, respectively, tend to maintain the gate 34 in a normally closed position across the otherwise open end of the coupling element 20*b*.

The gates 34 can be opened initially by the force of the legs 11*a* and 11*b* bearing against the outwardly facing surfaces of the gates in opposition to the bias of the springs 54 as the ladder 12 is being positioned for stabilization by the assembly 10. Once the legs 11*a* and 11*b* are inserted into the coupling elements 20*a* and 20*b* past the gates 34, the gates snap back from the open to the closed position against the stop member 50 once again and can not be opened outwardly by the ladder legs themselves or by any other means. To remove the ladder legs 11*a* and 11*b* from the coupling elements 20*a* and 20*b*, a person using the ladder 12 can climb down and dismount therefrom and, while standing in front of the ladder, reach through the ladder rungs or around a ladder leg with one hand and pull downwardly on a handle 62 attached to a vertically extending pull cord 64*a*, ring 66 and cord 64*b* to open the gates 34 inwardly to the position 34' (FIG. 6), while simultaneously using the other hand to tilt the ladder so that the ladder legs move toward an upright position out of the elements 20*a* and 20*b*. The ladder user may then release the handle 62 to permit the springs 54 to return the gates 34 to their closed positions and bring the ladder down or, otherwise, move the same as desired. The cord 64*a* has an upper end which is tied to the ring 66. The cord 64*b* is strung through the ring 66 to an approximate midpoint thereof, after which, opposite end portions of the cord are passed upwardly through a pull cord guide member or ring 68 (FIGS. 1–3 and 5) which is attached, as by a weld to a longitudinal center of the member 14. In the alternative, a hoist type eye bolt 69 (See FIGS. 6 and 9) can be substituted for the member 68 to permit a worker on the ladder to also connect his safety belt or harness thereto. When used for such purposes, I recommend that the eye bolt 69 have at least a 5,000 lb. maximum rating. The opposite end portions of the cord 64*b* then branch laterally to the right and left of the guide ring 68 and extend through holes 70 in the medial legs 44 into the coupling elements 20*a* and 20*b* to attachments 72 on free end portions of the gates 34. I prefer to form a small hole in a free end portion of each of the gates 34, pass a different end of the cord 64*b* through each of these holes and tie a knot on the ends of the cords, as at 72, to restrain the cord ends from being pulled back through the holes as the handle 62 is pulled downwardly to open the gates. The cord 64*a* should be of sufficient length such that the handle 62 will be at a convenient height above ground for being grabbed and pulled downwardly to open the gates 34 by a person standing on the ground immediately in front of or beside the ladder 12. An eye bolt 71 can be fastened to the structure to which the assembly 10 is mounted near the lower end of the cord 64*a* to confine the cord close to the structure as shown in FIG. 4.

In FIGS. 1–2 the mounting brackets 16 form an offset of the support member 14 from the gable 15 to allow clearance of the fasteners 18, which fasten the member 14 to the brackets, from the building. In FIG. 1, the brackets 16 are aligned with the support member 14 to permit the assembly 10 to be mounted horizontally across an upper end portion of the gable 15. FIG. 2 shows the same assembly 10 mounted to a rafter 75 of a sloping roof 76 so as to extend diagonally therealong. Notice in FIG. 2 that the coupling elements 20*a* and 20*b* are rotationally displaced about their fasteners 23 (FIG. 6) relative to the support member 14 as compared with FIG. 1 so as to accept the legs of a ladder therein even though the support member 14 and aligned brackets 16 extend diagonally along the slanted roof 76. In this manner, the assembly 10 could be affixed to one of the rafters along one side of the gable 15 if desired. The support member 14 can be provided with a series of spaced apart holes 77 for the fasteners 23 of the coupling elements 20*a* and 20*b* so that the coupling elements can be moved to various spaced apart positions to accommodate the legs of a ladder therein, whether the support member and brackets are fastened to a structure so as to extend parallel to the ground or so as to extend diagonal relative thereto.

Figure 3:
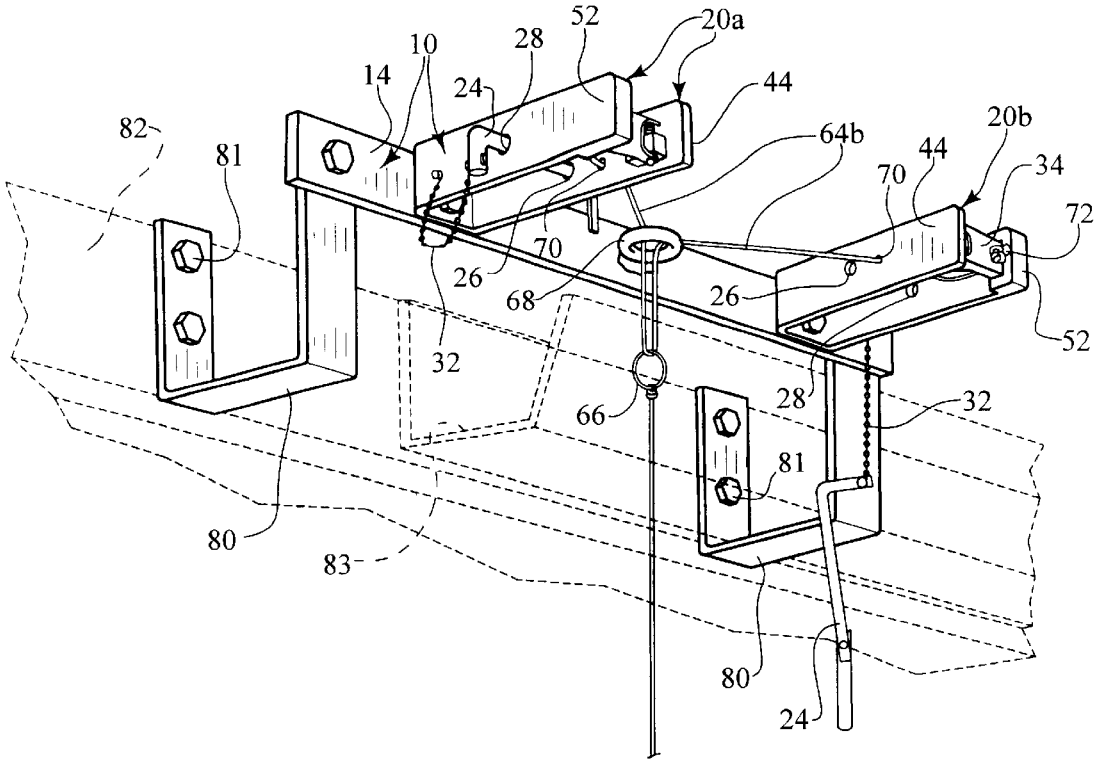
FIG. 3 shows a perspective view of the assembly of FIGS. 1–2 with U-shaped mounting brackets for positioning the assembly in front of a roof gutter and for attachment to a vertical building wall behind the gutter.
Figure 3:
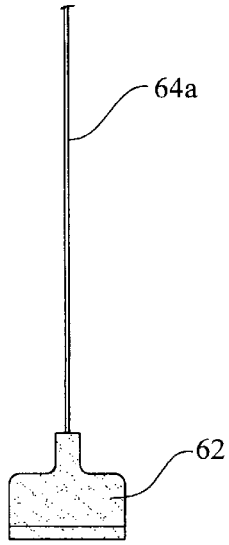
Figure 4:
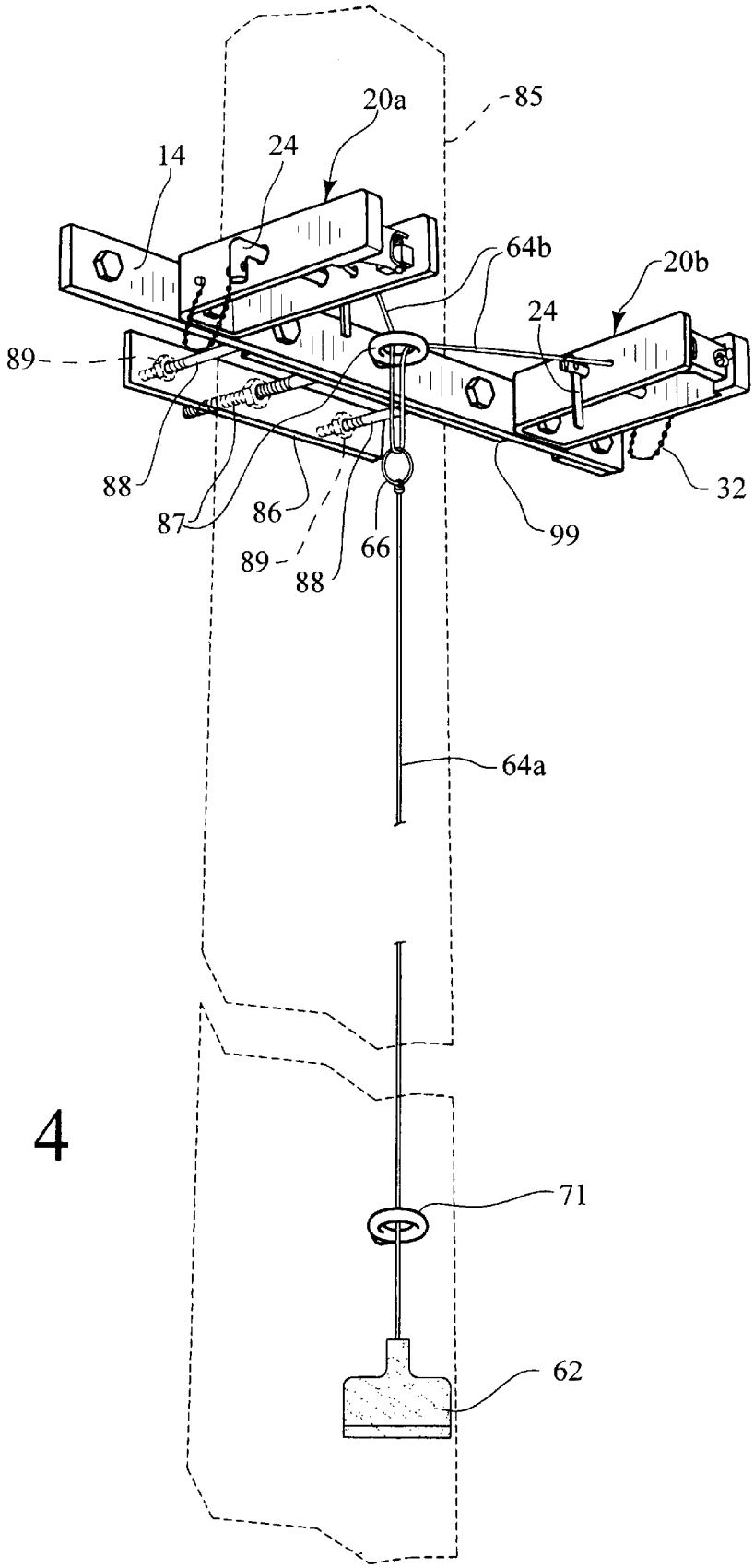
FIG. 4 shows a perspective view of essentially the same assembly as shown in FIGS. 1–3 but with modification and mounting means for attaching the assembly to a wooden utility pole.

Referring now to FIG. 3, the same ladder stabilizer assembly 10 is shown, except for a pair of mounting brackets 80 which, in this case, are U-shaped so as to fasten, as by means of bolts 81, to a vertical wall 82 immediately behind a roof gutter 83 and so that the support member 14 projects in front of the gutter. The gutter 83 thus extends through the brackets 80. Referring now to FIG. 4, the ladder stabilizer assembly 10 is shown which is identical to the assemblies of the previous examples except as to means for mounting the support member 14 to a structure, which structure, in this example, is a wooden utility pole 85. Instead of using a pair of brackets, as at 16 in FIGS. 1–2 and 80 in FIG. 3, the assembly 84 uses a single bar 86 which is positioned on an opposite side of the pole 85 from the support member 14 and which extends parallel to the latter mentioned member. A hoist type eye bolt 87 with a relatively long shank extends from the longitudinal center of the support member 14, through a hollow shaft which has been drilled in the pole 85 and finally, through a longitudinal center of the bar 86. A pair of bolts 88 extend through opposite end portions of support member 14, then pass immediately alongside the pole 85 and extend through opposite end portions of the bar 86. The bar 86 and support member 14 are held tightly against the pole 85 by means of hex nuts 89. A short reinforcing bar 99 may be attached, as by means of welding, to a longitudinally central portion of the support member 14 (See FIGS. 4 and 6) to minimize or prevent bending of the elongated support member 14 about the pole 85 which might otherwise occur in tightening of the hex nuts 89 on the bolts 88.

Figure 5:
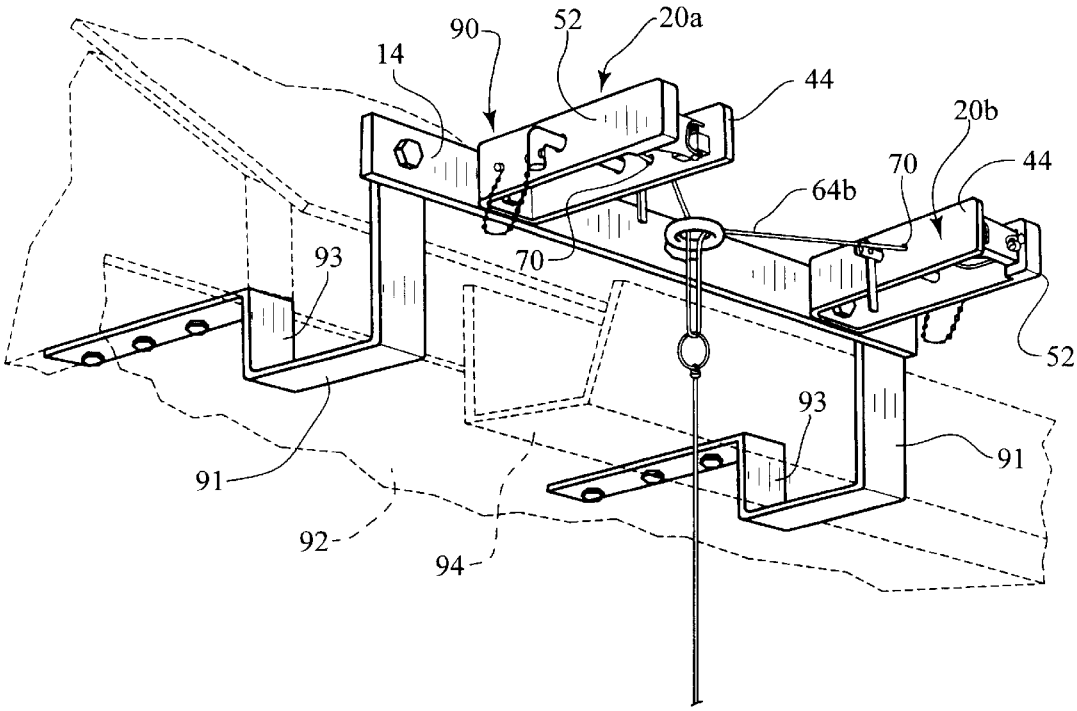
FIG. 5 shows a perspective view of essentially the same assembly as shown in FIGS. 1–4 with mounting brackets for mounting the assembly in front of a roof gutter, for accommodating the gutter therein, and for attachment to a cornice behind the gutter.
Figure 5:
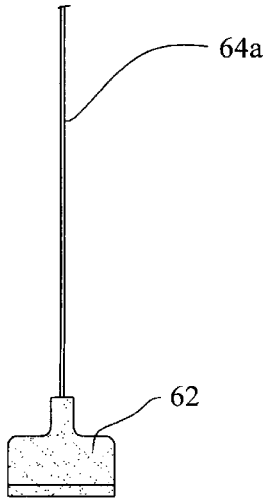

Referring to FIGS. 5–6, the ladder stabilizer assembly 10, is shown, which is identical to the assemblies of the previous examples except that, here, a pair of brackets 91 are used which permit attachment of the assembly 10 to the underside of a cornice 92 and which contain depressions 93 to accommodate a roof gutter 94 passing therethrough. The support member 14 of FIG. 5 thus projects immediately in front of and extends along the gutter 94. The ends of the brackets 93 which attach by bolts to the structure can be hidden under finished cornice boards and attached to roof structure in a concealed fashion under the cornice if desired. FIG. 8 shows the ladder stabilizer assembly 10, which is identical to the assemblies of the previous examples, except for a pair of offset brackets 96 which are adapted to accommodate a roof gutter 97 and attach directly to a vertical building wall 98 behind and below the gutter 97. The brackets 97 are similar in shape to the offset brackets 16 of FIGS. 1–2 except that, here, they are much larger in size to accommodate the gutter 97 above a central portion thereof.

Referring now to FIG. 9, the assembly 10 is shown with cornice attachment brackets 91, the same as in FIGS. 5–6, except that, here, the coupling elements 20*a* and 20*b* have been turned 90 degrees on their fasteners 23 relative to the support member 14 from their positions as shown in FIGS. 1, 3–6 and 8 so as to confine a rung 100 of the ladder 12 therein. An advantage in the arrangements of the assemblies 10, as shown in all but FIG. 4, is that they can be used and fastened to building structures to confine a ladder therein so as to avoid denting roof gutters and so as to prevent smashing roof shingles at the edge of a roof by the legs of the ladder otherwise being leaned thereagainst.

Although the present invention has been described with respect to specific details of certain preferred and other important embodiments thereof, it is not intended that such details limit the scope and coverage of this patent other than as specifically set forth in the following claims.

I claim:

1. A ladder safety assembly for stabilizing an upper end portion of a ladder when said ladder is disposed in an operative position against a structure to which the assembly is fastened, said ladder safety assembly comprising an elongated support member;

means for attaching said elongated support member to a structure against which a ladder is to be operatively positioned;

first and second U-shaped coupling elements attached in spaced apart relationship to opposite end portions of said support member, each of said first and second U-shaped coupling elements having an open end projecting forwardly from said elongated support member for insertion of a different leg of a ladder therethrough into a corresponding one of said first and second U-shaped coupling elements; and first and second safety latch members hingably attached, permanently and directly, to said first and second U-shaped coupling elements, respectively, each of said first and second safety latch members having a normally closed position for trapping a different leg of said ladder in a corresponding one of said first and second U-shaped coupling elements and an open position for permitting the selective removal of said ladder from said first and second U-shaped coupling elements when desired.

2. The assembly of claim 1 wherein each of said first and second U-shaped coupling elements is removably connected to said elongated support member.

3. The assembly of claim 1 wherein each of said first and second U-shaped coupling elements is rotatably connected on a base portion thereof to said elongated support member such that each of said first and second U-shaped coupling elements can be rotationally displaced about its longitudinal axis when desired.

4. The assembly of claim 1 further comprising first and second spring biasing means for respectively biasing said first and second safety latch members toward said normally closed position; and means for moving said first and second safety latch members from said normally closed position to said open position in opposition to said first and second spring biasing means for permitting removal of the legs of said ladder from said first and second U-shaped coupling elements when desired, said first and second safety latch members immediately returning to said normally closed position upon deactivation of said moving means.

5. The assembly of claim 1 further comprising first and second ladder leg snugging pins respectively attached by flexible members to said first and second U-shaped coupling elements, a pair of legs of each of said first and second U-shaped coupling elements containing at least one registered pair of holes therein for removable insertion of a corresponding one of said first and second ladder leg snugging pins therethrough to closely confine a corresponding leg of said ladder in a corresponding one of said first and second U-shaped coupling elements.

6. The assembly of claim 1 wherein said elongated support member attaching means comprises a pair of spaced apart, offset mounting brackets attached to opposite end portions of said elongated support member, each of said offset mounting brackets containing a central portion having a length which defines substantially the length of offset of said elongated support member from a structure to which said offset mounting brackets are to be secured, and a pair of end portions which extend at right angles from said central portion and in opposite directions from one another, corresponding ones of said end portions being fastened to opposite end portions of said elongated support member and the others of said end portions being fastenable to a wall structure.

7. The assembly of claim 1 wherein said elongated support member attaching means comprises a pair of Ushaped mounting brackets, each of said U-shaped mounting brackets having a central portion substantially defining a length of offset of said elongated support member from a structure to which said Ushaped mounting brackets are to be secured and a pair of end portions extending at a right angle from opposite ends of said central portion and in the same direction, corresponding ones of said end portions being attached to opposite end portions of said elongated support member and another end portion of each of said U-shaped mounting brackets being attachable to a structure wall such that said U-shaped mounting brackets can accommodate a roof gutter extending through and between each of said U-shaped mounting brackets behind said elongated support member.

8. The assembly of claim 1 wherein said elongated support member attaching means comprises a single flat bar, said single flat bar being positionable parallel to and spaced behind said elongated support member, said single flat bar containing a first bolt which extends through a longitudinal center thereof and through a longitudinal center of said elongated support member for insertion through a hollow shaft formed in a wooden pole against which said assembly is to be mounted, said single flat bar also containing second and third bolts located on opposite end portions thereof which extend through opposite end portions of said single flat bar and of said elongated support member, said second and third bolts being adapted to extend across opposite sides of said wooden pole from one another.

9. The assembly of claim 1 wherein said elongated support member attaching means comprises a pair of cornice mounting brackets attached to opposite end portions of said support member, each of said cornice mounting brackets containing a U-shaped end portion next to said elongated support member for accommodating a roof gutter therein, an opposite end portion of each of said cornice mounting brackets being straight and attachable to a roof cornice such that said elongated support member is positioned parallel to and in front of said roof gutter.

10. The assembly of claim 1 wherein each of said first and second safety latch members comprises a gate pivotally attached on one side thereof to a first leg of a different one of said first and second U-shaped coupling elements, and a pair of stop members, each of said stop members being fixedly attached to a second leg of a different one of said first and second U-shaped coupling elements, each said gate having a closed position extending across a front end portion of a different one of said first and second U-shaped coupling elements against a corresponding one of said stop members and an open position extending inwardly of a corresponding one of said first and second U-shaped coupling elements toward said elongated support member for permitting a different leg of said ladder to be moved into and out of a corresponding one of said first and second U-shaped coupling elements, and first and second biasing means tending to maintain said gates of said first and second U-shaped coupling elements in said closed position for preventing the legs of said ladder from being removed from said first and second U-shaped coupling elements, said gates being openable in opposition to said first and second biasing means by the force of the legs of said ladder pushing against a front surface of each of said gates in a direction inwardly of said first and second U-shaped coupling elements, and means for selectively opening said gates in opposition to said first and second biasing means from a position remote with respect to said elongated support member for permitting the legs of said ladder to be removed from said first and second U-shaped coupling elements.

11. The assembly of claim 1 further comprising a pull cord assembly connected between each of said first and second safety latch members to permit manual removal of the legs of said ladder from said first and second U-shaped coupling elements, each of said first and second safety latch members automatically returning to said normally closed position upon release of said pull cord assembly.

12. The assembly of claim 4 wherein said moving means comprises a pull cord assembly connected at one end thereof to each of said first and second safety latch members and extending downwardly from said elongated support member to a lower end located at a convenient height above the base of said ladder for grasping by a person standing near the base of said ladder for pulling downwardly thereon to open each of said first and second safety latch members to permit removal of the legs of said ladder from said first and second U-shaped coupling elements.

13. The assembly of claim 5 wherein each of said first and second ladder leg snugging pins comprises a gravity pin.

14. The assembly of claim 11 further comprising a pull cord guide ring fixedly attached to a longitudinal central portion of said elongated support member between said first and second U-shaped coupling elements and projecting forwardly therefrom, a first pull cord having one end portion extending through an opening in a medial leg of one of said first and second U-shaped coupling elements with a corresponding end thereof being operatively attached to one of said first and second safety latch members, an opposite end portion of said first pull cord extending through an opening in a medial leg of the other of said first and second U-shaped coupling elements with a corresponding end thereof being operatively attached to the other of said first and second safety latch members, a central portion of said first pull cord being inserted downwardly through said pull cord guide ring and, thereafter, through a rigid ring encircling said central portion of said first pull cord and positioned below said pull cord guide ring, and a second pull cord connected on one end to said rigid ring and hanging downwardly toward the ground near where the base of said ladder will sit when said ladder is held by said first and second U-shaped coupling pull cord being at least low enough for being pulled downwardly by a person standing near the base of said ladder when said ladder is held in said elements to open each of said first and second safety latch members to permit removal of said ladder from said first and second U-shaped coupling elements.

15. The assembly of claim 14 wherein said pull cord guide ring is welded to said elongated support member.

16. The assembly of claim 14 wherein said pull cord guide ring comprises an eye bolt removably attached to said elongated support member.

17. The assembly of claim 14 wherein said pull cord guide ring comprises a hoist type eye bolt removably attached to said elongated support member which has a failure rating suitable for attachment of a workers safety belt thereto.

18. A ladder safety assembly for stabilizing an upper end portion of a ladder when said ladder is disposed in an operative position against a structure to which the assembly is fastened, said ladder safety assembly comprising an elongated support member;

means for attaching said elongated support member to a structure against which a ladder is to be operatively positioned;

first and second U-shaped coupling elements attached in spaced apart relationship to opposite end portions of said elongated support member, each of said first and second U-shaped coupling elements having an open end projecting forwardly from said elongated support member for insertion of a different leg of a ladder therethrough into a corresponding one of said first and second U-shaped coupling elements;

first and second safety latch members hingably attached, permanently and directly, to said first and second U-shaped coupling elements, respectively, each of said first and second safety latch members having a normally closed position for trapping a different leg of said ladder in a corresponding one of said first and second U-shaped coupling elements and an open position for permitting the selective removal of said ladder from said first and second U-shaped coupling elements when desired; and first and second ladder leg snugging pins, each of said first and second ladder leg snugging pins being removably insertable through a medial and lateral leg of a different one of said first and second U-shaped coupling elements for closely confining the legs of said ladder in said first and second U-shaped coupling elements.

* * * * *